United States Patent [19]

Nguyen et al.

[11] Patent Number: 4,560,446

[45] Date of Patent: Dec. 24, 1985

[54] METHOD OF ELECTROPLATING, ELECTROPLATED COATING AND USE OF THE COATING

[75] Inventors: Thinh Nguyen, Onex; Jean-Pol Wiaux, Croix-de-Rozon; Christopher J. Vance, Chêne-Bougeries, all of Switzerland

[73] Assignee: ELTECH Systems Corporation, Boca Raton, Fla.

[21] Appl. No.: 683,006

[22] Filed: Dec. 18, 1984

[30] Foreign Application Priority Data

Dec. 23, 1983 [EP] European Pat. Off. ..... 83810617.7

[51] Int. Cl.[4] ..... C25D 3/44

[52] U.S. Cl. ..... 204/58.5

[58] Field of Search ..... 204/58.5, 14.1, 39

[56] References Cited

U.S. PATENT DOCUMENTS

| | | | |
|---|---|---|---|
| 2,170,375 | 8/1939 | Mathers | 204/58.5 |
| 3,775,260 | 11/1973 | Capuano | 204/58.5 |
| 3,997,410 | 12/1976 | Gileadi | 204/58.5 |
| 4,003,804 | 1/1977 | Wong | 204/58.5 |
| 4,381,976 | 5/1983 | Armand | 204/64 T |

FOREIGN PATENT DOCUMENTS

| | | | |
|---|---|---|---|
| 945935 | 4/1974 | Canada | 204/58.5 |

OTHER PUBLICATIONS

"Electrodeposition of Metals from Organic Solutions" Jnl. of Electrochemical Socy., Jan. 1957, pp. 21–29.

*Primary Examiner*—T. M. Tufariello

*Attorney, Agent, or Firm*—Arthur S. Collins; John J. Freer

[57] ABSTRACT

Transition metals of the groups IVB, VB and VIB or alloys thereof with Al are electrodeposited in a system of an electrolyte based on an aromatic hydrocarbon. The electrolyte is originally prepared by dissolving 0.02 to 0.2 moles of an inexpensive high oxidation state transition metal halide and 0.2 to 0.5 moles $AlBr_3$ in 1.00 mole of the aromatic hydrocarbon. Additions of transition metal powders or Mg or Al particles lead to the pre-reduction of the high oxidation state transition metal ions to lower oxidation states. Alkali metal or Mg halides may be used to establish favorable bath conditions. The electrolysis is carried out with dissolvable metal anodes, to maintain the bath composition. The plating current density, bath composition and method of preparation are chosen to obtain the desired composition of the coatings.

26 Claims, No Drawings

METHOD OF ELECTROPLATING, ELECTROPLATED COATING AND USE OF THE COATING

FIELD OF INVENTION

The invention relates to a method of electroplating at least one or an alloy of several transition metals of the groups IVB, VB or VIB of the periodic table or an alloy of at least one of said transition metals with aluminum at near ambient temperature onto an electrically conductive substrate in a non-aqueous electrolyte. The invention further relates to an electroplated coating and to the use of this coating.

BACKGROUND OF THE INVENTION

It is known to apply coatings of metals, alloys etc. onto conductive substrates by way of electroplating.

The Canadian Pat. No. 945,935 discloses the electrodeposition of Al or alloys containing Al onto substrates in electrolytes based on a non-aqueous organic solvent like toluene, whereby the metal salts are added to the solvent in the form of bromides and/or chlorides.

However, this Canadian patent does not disclose the electrodeposition of transition metals of the groups IVB, VB or VIB, or of alloys thereof with Al from a non-aqueous electrolyte.

From the "Journal of Electrochemical Society", January 1957, page 21, it is known to electrodeposit Ti alloys from a non-aqueous bath, specially from ether containing Al complexes. Deposits of maximum 6% Ti, rest Al, could be obtained. Deposits with higher contents of Ti could not be achieved. Moreover, because of the high flammability of ether and its low electrical conductivity the practical operating conditions are highly disadvantageous.

The French Pat. No. 2 494 726 discloses a process of a fused salt titanium electrowinning electrolysis, whereby the bath is heated to a temperature of 520° C. A process like this may in principle be used for electroplating, but it is highly desirable to perform the entire procedure at low temperatures.

OBJECT OF THE INVENTION

It is one object of the invention to provide a method which allows one to electrodeposit transition metals or alloys thereof with Al onto a substrate at temperatures near ambient temperature under safe and economic operating conditions.

It is another object of the invention to provide a method for electroplating the above mentioned metals or alloys in a maximum wide range of compositions of the deposit, whereby the desired composition of the deposit may be obtained by suitable choice of additives and operating conditions such as plating current density, bath composition and method of bath preparation.

Still another object of the invention is the provision of a coating which has a good resistance against corrosion and which is applicable to complex as well as simple structures.

SUMMARY OF THE INVENTION

The above objects are met by a method of electroplating as set out under the heading "Field of Invention" which is further characterized in that the electroplating is carried out in an electrolyte comprising an aromatic hydrocarbon and an aluminum halide, wherein said transition metal(s) is (are) dissolved in the form of halides of a high oxidation state, said transition metal(s) being pre-reduced to a lower oxidation state.

The pre-reduction of the transition metal ions from a high oxidation step to a lower one allows one to use inexpensive high oxidation state-salts of the particular transition metal for the initial preparation of the plating bath, and it may be carried out by pre-electrolysis or by metallic reducing agents.

The pre-reduction by metallic reducing agents may be carried out by the addition of a powder of the same transition metal(s) as is (are) being plated. Other possible reducing agents are Al, Mg or alkali metals.

It was found that the use of Mg as a reducing agent leads to the formation of different complexes which yield high contents of the transition metal(s) in the deposit.

The aromatic hydrocarbon may be benzene or an alkyl benzene such as toluene, ethyl benzene, xylene or a mixture thereof. The transition metals to be electroplated may be dissolved therein in the form of bromides and/or chlorides. The plating bath may further comprise an alkali metal halide such as a bromide or a chloride of Li, Na, or K, the amount of which influences the acidity of the bath and thereby controls the composition of the deposit.

The molar concentration of the halide(s) of the transition metals:the Al halide:the aromatic hydrocarbon may be in the range of 0.02 to 0.20:0.20–0.50:1.00, the cathodic plating current density being in the range of 5–100 mA/cm$^2$, a preferred range being from 15 to 40 mA/cm$^2$.

The composition of the deposit may be determined by the appropriate choice of the plating current density, as well as by a specific bath composition or its preparation.

The reducing agent may have a molar concentration of 0.02–0.2 per 1 mole of the aromatic hydrocarbon.

The alkali metal halide may have a molar concentration of 0.01–0.3 per 1 mole of the aromatic hydrocarbon.

In the case of plating a Ti/Al alloy the electrolyte may comprise $TiBr_4$, $AlBr_3$, toluene, Mg and one of LiCl and KBr in a molar concentration of

| | |
|---|---|
| $TiBr_4$ | 0.025–0.1 |
| $AlBr_3$ | 0.20–0.33 |
| toluene | 1 |
| Mg | 0.01–0.13 |
| LiCl or KBr | 0.005–0.15 |

The electroplating process may be carried out using feed anodes comprising the same metal(s) which is (are) electrodeposited onto a cathodically polarized substrate.

The application of the electroplating method according to the invention may be of special advantage in connection with substrates comprising nickel or an intermediate layer of nickel or a nickel alloy such as super alloys. The particular advantage thereof is the formation of coatings comprising intermetallic compounds of at least one component of the substrate and at least one component of the coating due to outwards diffusion of e.g. nickel into the coating during a suitable heat treatment e.g. at temperatures between 400°–1200° C. In the case of a Ti/Al coating a nickel aluminide intermetallic compound is formed which has an enhanced stability in high temperature environments.

The invention further relates to a coating comprising at least one or an an alloy of several transition metals of the groups IVB, VB or VIB of the periodic table or an alloy thereof with aluminum, the coating being produced by electroplating in an electrolyte comprising an aromatic hydrocarbon and an aluminum halide, wherein said transition metal(s) is (are) dissolved in the form of halides of a high oxidation state, said transition metal(s) being pre-reduced to a lower oxidation state.

The composition of the coating may comprise 1–95 w% of the transition metal(s) and 99–5 w% aluminum.

The above coating may be used for corrosion protection of the coated substrates in aqueous solutions or high temperature gaseous environments.

DETAILED DESCRIPTION OF THE INVENTION

1. Basic Principle

In a pure Al halide/aromatic hydrocarbon system which is considered to be one of the strongest acidic solvents at ambient temperatures the Al species is $Al_2X_6$. The dissolution of a metallic halide in this solvent system occurs according to the following acid-base interactions:

$$nAl_2X_6 + MX_n \rightleftarrows M(Al_2X_7)_n$$

$$M(Al_2X_7) + MX_n \rightleftarrows 2M(AlX_4)_n$$

The identity of the predominant Al species ($Al_2X_6$, $Al_2X_7^-$, or $AlX_4^-$) depends on the molar ratio $R = MX_n:AlX_3$. For values of R being smaller than, approximately equal or bigger than 0.5, $Al_2X_6$, $Al_2X_7^-$ or $AlX_4^-$ respectively is the predominant form. The reduction potential of these Al species gradually shift to more negative values in the above indicated sequence.

Thus in varying the value of R the reduction potential of the Al species may be adjusted and therewith a desired content of M and Al in the deposit may be obtained.

However, the formation of $Al_2X_7^-$ and $AlX_4^-$ species depends also on the basicity of the used metal halide $MX_n$, which in the case of transition metal halides of the groups IVB, VB and VIB is rather weak, so that the inhibition of the Al reduction by the transition metal halide is often incomplete, which leads to Al rich deposits.

To overcome this difficulty, a mixed system composed of a transition metal halide and an alkali metal halide is proposed according to a preferred embodiment of the invention.

2. Pre-Reduction Principle

Because of the strong oxidant character of the transition metal ions of the groups IVB, VB and VIB at high oxidation states (+6, +5, +4, +3) the pre-reduction of the latter to a lower oxidation state is necessary before the plating process.

For a plating process the chemical pre-reduction is certainly more advantageous than pre-electrolysis, which requires a specific cell, electrodes, etc.. Specially in the case where the high oxidation state compounds of the transition metals have a low solubility, the chemical pre-reduction to a lower oxidation state increases the ionic character of these compounds which increase their solubility by favouring the acid-base interaction with the Al halide.

To avoid problems of bath contamination it is preferable to use a reductant of which the final product is one of the elements of the original bath composition. For example in the case of Ti the following reductants may be used:

(a) Transition metal to be plated:

$$TiBr_4 + Ti \xrightarrow{4AlBr_3} 2(TiBr_2.2AlBr_3)$$

(b) Aluminum:

$$TiBr_4 + 2/3Al \xrightarrow{4/3AlBr_3} (TiBr_2.2AlBr_3)$$

(c) Alkali metal:

$$TiBr_4 + 2M \xrightarrow{3AlBr_3} (TiBr_2.2AlBr_3) + 2MAlBr_4$$

In these three cases the products of the pre-reduction are either a complex of the transition metal or the latter plus the supporting electrolyte complex.

3. Pre-reduction with magnesium

Theoretically the pre-reduction of $TiBr_4$ by Mg should follow the equation:

$$TiBr_4 + Mg \xrightarrow{3AlBr_3} (TiBr_2.2AlBr_3) + Mg(AlBr_4)_2$$

The Mg complex may be used as the supporting electrolyte instead of an alkali metal complex. However, it is known, that $Mg(AlBr_4)_2$ is practically insoluble in aromatic hydrocarbon, and therefore no specific effect of Mg should be expected.

It was found, however, by a composition analysis of the solution $TiBr_4/AlBr_3$/Toluene reduced by Mg that the above reaction does not occur, the atomic ratios of Ti:Mg, and Ti:Al in solution suggesting the formation of a new complex:

$$TiBr_4 + Mg \xrightarrow{3AlBr_3} (TiMgBr_4.3AlBr_3)$$

which is soluble in aromatic hydrocarbon.

By using this specific complex under appropriate conditions, deposits which are rich in transition metals (e.g. 64 wt% Ti, or 95 wt% Mo) can be obtained.

The above described reactions prepare the electrolyte for the plating step which follows the reaction:

$$xTi^{2+} + yAl^{3+} + (2x+3y)e^- \rightarrow Ti_xAl_y$$

for the cathodic reaction, and $$xTi \rightarrow xTi^{2+} + 2xe^-$$

$$yAl \rightarrow yAl^{3+} + 3ye^-$$

for the anodic reactions in the case that feed anodes are used, which replace the deposited ions at the same rate as they are removed from the bath.

4. Substrates

The above described method of electroplating may in principle be applied to any metallic substrates, however, it reveals special advantages in connection with certain specific metallic substrates.

Among those are in particular nickel, cobalt, iron and/or titanium containing substrates such as super alloys, or any basic substrate comprising an intermediate nickel containing layer. The specific advantages of the above substrate-coating combination becomes apparent after a suitable heat treatment of the coated substrate, which leads to a limited interdiffusion of the nickel into the coating. Thereby, an intermetallic compound of nickel and e.g. aluminum is formed, which is stable at high temperatures, thus providing an enhanced corrosion protection for the substrate at high temperatures up to more than 1300° C.

EXAMPLES

Example 1

In a glove-box with an Argon atmosphere containing less than 3 ppm of water, a solution of $TiBr_4$:$AlBr_3$:toluene was prepared by adding 0.080 mole of $TiBr_4$ (Ventron—99.6% pure), 0.330 mole of $AlBr_3$ (Cerac—99.5% pure) to 1.000 mole of toluene (Merck—pro analysis—99.5%—distilled and stored over Na).

The solution was placed in a cylindrical glass cell, with a magnetic stirrer. A Cu cathode of dimensions 2.5×6.5 cm and the Ti anodes of the same dimensions were fixed to the cell top made of Teflon ®. The cathode-anode distances were about 1.0 cm. The solution temperature was maintained at 60° C.

The pre-electrolysis was made at a cathodic current density of 20 mA/cm$^2$. After the passage of 19, 200 Asec, traces of a "silver-white" deposit were observed at the cathode surface: the pre-electrolysis step was achieved and the totality of $Ti^{4+}$ species was reduced to $Ti^{2+}$ with a current efficiency of about 84%. The plating bath was now ready for the deposition of Ti/Al alloys.

New Cu substrates of dimensions 2.5×6.5 cm were etched in a solution 1:1:1 of $HNO_3$:$H_3PO_4$:$CH_3COOH$ for 30 sec., rinsed with water, afterwards with acetone, dried in air, and introduced into the glove-box.

A Cu substrate was placed as a cathode in an electrolysis cell. The deposition of Ti/Al alloys was carried out at 60° C., and at different cathodic current densities within the range of 10 to 37 mA/cm$^2$. The cell voltage was between 7 and 20 volts, depending on the applied current density. After the passage of 800 Asec, the immersed surface of the Cu substrate was covered by a "silver-white" coating. The qualitative analysis of the deposit was made by x-ray diffraction, showing the presence of metallic phases of Ti and Al. The quantitative analysis was made by atomic absorption: the deposit was dissolved in a boiling solution of 10% HCl, the standard solutions of Ti and Al mixtures were used as the references. The composition of the deposit, as a function of the applied current density, is given in Table 1.

TABLE 1

| i cathodic (mA/cm$^2$) | CE (%) | Deposit Composition (wt %) Ti | Al |
|---|---|---|---|
| 10 | 18.1 | 2.4 | 97.6 |
| 20 | 26.3 | 3.0 | 97.0 |
| 30 | 38.2 | 7.9 | 92.1 |
| 37 | 53.9 | 14.2 | 85.8 |

Example 2

A solution of $TiBr_4$:$AlBr_3$:toluene (molar composition 0.080:0.330:1.000) was prepared as in Example 1. Afterwards a large excess of 0.21 gr.at. of Ti powder (Cerac—99.5%—150+325 mesh) was added to the solution, which was placed in a closed vessel. The mixture was heated to 60°-80° C. and strongly stirred for 4 to 6 hours. Afterwards, the solution, with the excess of Ti powder, was placed in an electrolysis cell as described in Example 1. The electrolyte temperature was maintained at 60° C., and the Ti powder was kept in suspension by a strong magnetic stirrer. The electrolysis was carried out at 30 mA/cm$^2$. The deposition of Ti/Al alloys occurred immediately, without any pre-electrolysis.

Twelve samples were produced under the above conditions for 6 days with the same plating bath with a charge of 800 Asec per electrolysis. The quantitative analysis of the 12 resulting deposit samples gave a composition of 8 to 10 wt% Ti and 90 to 92 wt% Al. The average value of the current efficiency was about 50%.

Example 3

A solution of $TiBr_4$:$AlBr_3$:toluene (molar composition 0.080:0.330:1.000) was prepared as in Example 1. The pre-reduction of $Ti^{4+}$ to $Ti^{2+}$ species was made with Ti powder as in Example 2.

The electrodeposition of Ti/Al alloys was carried out in an electrolysis cell described as in Example 1, at 60° C. A pulsed cathodic current was used. The peak current density (ipc) and the on:off time ratio of the pulsed current were calculated to obtain a constant effective cathodic current density of 20 mA/cm$^2$. The cell voltage was about 12 to 14 volts. After the passage of 800 Asec, the deposit was dissolved in HCl 10% and the composition, given in Table 2, was analyzed by atomic absorption.

TABLE 2

| ipc (mA/cm$^2$) | on:off (msec) | CE (%) | Deposit Composition (wt %) Ti | Al |
|---|---|---|---|---|
| 50 | 1:2 | 69.0 | 16.7 | 83.3 |
| 80 | 1:3 | 69.2 | 18.2 | 81.8 |
| 120 | 1:5 | 55.0 | 10.7 | 89.3 |

Example 4

A solution of $TiBr_4$:$AlBr_3$:toluene (molar composition 0.080:0.330:1.000) was prepared as in Example 1. The pre-reduction of $Ti^{4+}$ to $Ti^{2+}$ was made with Ti powder as in Example 2. After the pre-reduction step, 0.032 mole of KBr (Merck—pro analysis 99.5%) was added to the plating bath.

The electrodeposition of Ti/Al alloys was carried out under similar conditions as described in Example 3. A pulsed cathodic current was used with an $i_{pc}$ of 40 mA/cm$^2$ and an on:off ratio of 1:1 (msec), giving an effective cathodic current density of 20 mA/cm$^2$, and a cell voltage of about 5 volts.

After the passage of 800 Asec, the grey metallic deposit obtained was analysed by atomic absorption and gave a composition of 21 wt% Ti and 79 wt% Al. The current efficiency was 65.3%.

Example 5

A solution of $TiBr_4$:$AlBr_3$:toluene (molar composition 0.100:0.330:1.000) was prepared as in Example 1.

Afterwards, the pre-reduction of $Ti^{4+}$ to $Ti^{2+}$ was made by addition of 0.130 gr.at. of Mg particles (Merck—99% for Grignard reagent) under the same conditions as in Example 2. After the pre-reduction step, 0.005 mole of KBr was added to the electrolyte.

The electrodeposition of Ti/Al alloys was carried out directly, without any pre-electrolysis step. The electrolysis conditions were similar to those described in Example 1. At a cathodic current density of 5 mA/cm$^2$, with a cell voltage of 4 to 6 volts, a grey metallic deposit was obtained onto a Cu substrate. A total of 800 Asec of charge was passed.

The deposit was dissolved first in 10% HCl at room temperature. After 30 minutes of dissolution, the Cu substrate, still covered by a thin, grey deposit layer was removed from the HCl solution, washed with water, and the dissolution of the deposit was continued with a new solution of 10% HCl at the boiling point. The atomic absorption analysis of the two dissolution solutions showed respectively a composition of 31.8 wt% Ti and 68.2 wt% Al for the first solution, and practically pure Ti for the second one.

Example 6

A solution of $TiBr_4$:$AlBr_3$:toluene (molar composition 0.025:0.100:1.000) was prepared as in Example 1. The pre-reduction of $Ti^{4+}$ to $Ti^{2+}$ was made by addition of 0.033 gr.at. of Mg particles under the same conditions as in Example 2. After the pre-reduction step, a mixture of 0.08 mole of KBr and 0.200 mole of $AlBr_3$ was added to the electrolyte.

The electrolysis was carried out at 60° C., with a cylindrical rotating cathode, made of Cu tube of 10 mm diameter and 100 mm length. A cylindrical Ti anode of 40 mm diameter and 100 mm length was used. A separate compartment containing an Al wire immersed in the plating solution served as the reference electrode. The cathode rotation speed was about 5000 rpm. A pulsed cathode potential was used between the limits of −0.5 and −0.2 volts vs. the Al reference electrode, with an on:off ratio of 0.5:2.0 (sec). The cathodic current density was stabilized between the two limit values of 0 and 12 mA/cm$^2$ after 5 minutes of electrolysis. After the passage of 850 Asec, a grey metallic deposit obtained at the immersed surface of the Cu substrate was analysed. The x-ray diffraction analysis, at the surface deposit, showed the presence of TiAl intermetallic phase as the only crystallic phase (composition 64 wt% Ti and 36 wt% Al), no pure Ti, Al or Mg phase was observed. The global composition of the deposit was obtained by atomic absorption analysis. No Mg was detected, the total quantity of Ti and Al in the deposit corresponded to the composition of 53 wt% Ti and 47 wt% Al.

Example 7

Four solutions of $TiBr_4$:$AlBr_3$:toluene (molar composition 0.025:0.100:1.000) were prepared as in Example 1. The pre-reduction of Ti species was made with Mg particles as in Example 6. Afterwards, 0.200 mole of $AlBr_3$ and respectively 0.080, 0.090, 0.100 and 0.110 mole of KBr were added into each of the four solutions of $Ti^{2+}$ complex.

The electrolysis were carried out under similar experimental conditions as in Example 6, with a cylindrical rotating Cu cathode. A pulsed cathodic current was used with an ipc of 10 mA/cm$^2$ and an on:off ratio of 1:4 (msec). After the passage of 850 Asec the composition of deposits onto the four Cu substrates was analyzed by atomic absorption, the results are listed in Table 3.

TABLE 3

| Molar ratio of the added mixture KBr:$AlBr_3$ | Deposit composition (wt %) | |
|---|---|---|
| | Ti | Al |
| 0.080:0.200 | 53.0 | 47.0 |
| 0.090:0.200 | 54.0 | 46.0 |
| 0.100:0.200 | 11.0 | 89.0 |
| 0.110:0.200 | 5.0 | 95.0 |

Example 8

A solution of $Ti^{2+}$ complex (initial molar ratio 0.025 $TiBr_4$:0.100 $AlBr_3$:1.000 toluene+0.033 gr.at. Mg) was prepared as in Example 6. After the pre-reduction step a mixture of 0.090 mole of KBr and 0.200 mole of $AlBr_3$ was added to the electrolyte.

The electrolysis were carried out under similar conditions as in Example 6, with a cylindrical rotating Cu cathode. A pulsed cathodic current was used, with different values for ipc and with an on:off ratio of 1:4 (msec). After the passage of 850 Asec, the deposits were dissolved in a boiling solution of 10% HCl, and the composition was analyzed by atomic absorption. The deposit composition, as the function of the applied value of ipc, is given in Table 4.

TABLE 4

| ipc (mA/cm$^2$) | Deposit composition (wt %) | |
|---|---|---|
| | Ti | Al |
| 6.4 | 54.0 | 46.0 |
| 12.7 | 47.4 | 52.6 |
| 25.5 | 18.2 | 81.8 |
| 38.2 | 13.7 | 86.3 |

Example 9

A solution of $TiBr_4$:$AlCl_3$:toluene (composition 0.025:0.100:1.000) was prepared at room temperature. The pre-reduction of $Ti^{4+}$ to $Ti^{2+}$ was made by addition of 0.033 gr.at. of Mg particles, and by heating at 60° C. for 6 hours. After the pre-reduction step, a mixture of 0.12 mole of LiCl and 0.300 mole of $AlCl_3$ was added to the electrolyte.

The electrolysis were carried out under similar conditions as in Example 6, with a cylindrical rotating Cu cathode, and an Al anode of 40 mm diameter and 100 mm length. A pulsed cathodic current was used with different values of ipc and with and on:off ratio of 1:4 (msec). After the passage of 850 Asec, the composition of the deposits obtained was determined by atomic absorption analysis. Within an ipc range of 5 to 25 mA/cm$^2$ the compositions of the deposits, obtained by atomic absorption analysis, were between 9 and 11 wt% Ti and between 89 and 91 wt% Al, with a CE between 59 and 65%.

Example 10

Two solutions of $TiBr_4$:$AlBr_3$:toluene (molar ratio 0.055:0.330:1.00) were prepared as in Example 1. The pre-reduction of $Ti^{4+}$ species was made by addition of 0.100 gr.at. of Ti powder, and by heating at 60° C. for 6 hours. Afterwards a quantity of $MgBr_2$ (Cerac—99.8%) corresponding respectively to 0.090 mole and 0.130 mole was added to each of the two solutions. The deposition of Ti/Al alloys was made respectively from these two baths, under similar experimental conditions as in Example 6. The cathode potential was maintained constant respectively at −0.5 and −1.0 volts vs. Al reference electrode. After the passage of 800 Asec, the grey metallic deposits were dissolved in a boiling solution of HCl 10% and the compositions were analyzed by atomic absorption. The results are listed in Table 5.

TABLE 5

| Bath composition $TiBr_2$:$AlBr_3$:$MgBr_2$:toluene (molar ratio) | Deposit composition (wt %) at −0.5 volt Ti | Al | at −1.0 volt Ti | Al |
|---|---|---|---|---|
| 0.110:0.330:0.090:1.000 | 8.3 | 91.7 | 13.5 | 86.5 |
| 0.110:0.330:0.090:1.000 | 8.8 | 91.2 | 10.7 | 89.3 |

Example 11

A solution of $MoBr_3$:$AlBr_3$:toluene was prepared by adding 0.025 mole of $MoBr_3$ (Cerac—99.8%), 0.330 mole of $AlBr_3$ and 1.000 mole of toluene. The pre-reduction of $Mo^{3+}$ species to the lower oxidation state (probably mixture of $Mo^{2+}$ and $Mo^{+}$) was made by addition of 0.030 gr.at. of Mg particles, and by heating at 60° C. for 6 hours. Afterwards a 0.198 mole of KBr was added to the plating bath.

A glass electrolysis cell, with a rotating Cu cathode, and a cylindrical Al anode described as in Example 6 was used. The electrolysis was carried out at 60° C. and the cathode potential was maintained constant at −0.2 volts vs. Al reference electrode. The cathodic current density stabilized rapidly at about 5 mA/cm$^2$. After the passage of 800 Asec, a thin layer of about 1.2 micron of a "steel grey" deposit was obtained. This deposit was stable in a boiling solution of 10% NaOH. The deposit was dissolved in a hot solution of $HNO_3$ concentration. The qualitative analysis of the resulting solution made with $NH_4SCN$ showed the presence of Mo. The x-ray diffraction analysis of the deposit showed the presence of about 5 wt% of Al phase.

Example 12

A solution of $MoBr_3$:$AlCl_3$:toluene (molar ratio 0.025:0.330:1.000) was prepared as in Example 11. The pre-reduction of $Mo^{3+}$ was made by addition of a large excess (about 5 g) of Al particles. Afterwards, 0.198 mole of LiCl was added to the electrolyte.

A glass cylindrical cell with a rotating cathode and a cylindrical Al anode described as in Example 6 was used. A tube of mild steel of 10 mm diameter and 100 mm length was used as the substrate, which was etched in 10% HCl for five minutes, rinsed with water and with acetone and dried in air. Before the cathodic deposition, the substrate was anodized at 10 mA/cm$^2$ for 5 minutes. Afterwards the polarity of the electrodes was reversed immediately and the deposition of Mo/Al alloys was carried out at different cathodic current densities within the range of 8 to 40 mA/cm$^2$. Very dense and bright deposits were obtained after a short polishing step with $Al_2O_3$ powder. The adherence of the deposit onto steel substrates was proved by cutting and bending tests of the tube. The composition of the deposits was analyzed by SEM method. Microhardness measurements were made, the results of which are listed in table 6.

TABLE 6

| Deposition current density (mA/cm$^2$) | CE (%) | Comp. (wt %) Mo | Al | Hardness (HV) |
|---|---|---|---|---|
| 8 | 84 | 20.9 | 79.1 | 232.8 |

TABLE 6-continued

| Deposition current density (mA/cm$^2$) | CE (%) | Comp. (wt %) Mo | Al | Hardness (HV) |
|---|---|---|---|---|
| 20 | 93 | 18.6 | 81.4 | 259.6 |
| 25 | 97 | 16.3 | 83.7 | 282.3 |
| 37 | 95 | 18.0 | 82.0 | 257.8 |
| 40 | 90 | 15.6 | 84.4 | 222.5 |

Example 13

A Ti/Al plating bath was prepared as in Example 8 with the same composition. The electrolysis were carried out with the cell described as in Example 12. The mild steel substrates were etched in HCl solution as above. Before the cathodic deposition of Ti/Al the substrate was anodized at 20 mA/cm$^2$ for 2 to 5 minutes. Afterwards the electrolysis circuit was opened and the substrate was allowed to stay in the electrolyte for about 30 minutes. During this rest period, a strong agitation is necessary.

After the surface treatment step, the deposition of Ti/Al alloys was carried out with a pulsed current at an ipc between 3 and 13 mA/cm$^2$ and an on:off ratio between 0.25 and 2.5(sec). Following the experimental conditions, three series of Ti/Al coatings of composition: (a) 5 to 10% Ti; (b) 16 to 20% Ti and (c) 30 to 37% Ti were obtained onto the steel tube. The deposits were polished with a mixture of $Al_2O_3$+water. The thickness of the deposit was between 30 and 40 micron. The adherence was proved by cutting and bending tests. The corrosion resistance of the coating was evaluated by a standard saline spray test, the results are listed in Table 7.

TABLE 7

| Sample | Life time in saline spray test (hours) |
|---|---|
| (a) | More than 2592 hrs. |
| (b) | More than 2592 hrs. |
| (c) | More than 2592 hrs. |
| pure Al | 1224 hrs. (75% red rust) |

Example 14

A solution of LiCl:$AlCl_3$:Toluene (molar ratio 0.198:0.330:1) was prepared at room temperature. Afterwards 0.033 moles of $CrCl_3$ (Ventron-puriss quality) and about 3 g of Al particles were added to the electrolyte. The solution was heated up to 80° C. in a closed vessel. $CrCl_3$ which is practically insoluble was kept in suspension by a strong magnetic stirrer. The reduction of $Cr^{3+}$ to $Cr^{2+}$ was completed after about 10–12 hours, and a dark green final solution was obtained.

The electrolyte was placed in an electrolysis cell as described in example 1. A Cu cathode of dimensions 2.5×6.5 cm and two Al anodes of the same dimensions were used.

The electrolysis was carried out at different current densities. The deposit compositions were analysed by atomic absorption, the results of which are listed in table 8.

TABLE 8

| i (mA/cm$^2$) | Deposit Composition (wt %) Cr | Al | Hardness (HV) |
|---|---|---|---|
| 10 | 21.5 | 78.5 | 322 |
| 20 | 30.0 | 70.5 | 464 |
| 30 | 43.0 | 57.0 | 464 |
| 40 | 52.5 | 47.5 | 420 |

TABLE 8-continued

| i (mA/cm²) | Deposit Composition (wt %) Cr | Al | Hardness (HV) |
|---|---|---|---|
| 50 | 6.0 | 94.0 | 116 |

Example 15

A quantity of $TiBr_4$ corresponding to 0.010 moles was added to the electrolyte of example 14. The interaction between $Ti^{4+}$ and $Cr^{2+}$ occurred immediately and led to the formation of a dark precipitate. Afterwards 2 g of Al particles were added to the mixture, and the solution was heated to 80° C. for 4 hours. A final dark brown solution was obtained.

The electrolysis was carried out under similar conditions as described in example 14. The results of deposit composition analysis are listed in table 9.

TABLE 9

| i (mA/cm²) | Deposit Composition (wt %) Cr | Ti | Al | Hardness (HV) |
|---|---|---|---|---|
| 10 | 2.0 | 6.0 | 92.0 | 116 |
| 15 | 1.0 | 7.6 | 91.4. | 200 |
| 20 | 1.0 | 12.0 | 87.0 | 180 |
| 30 | 1.0 | 14.3 | 84.7 | 200 |
| 40 | 6.7 | 26.0 | 67.3 | 322 |
| 50 | 16.0 | 9.0 | 75.0 | 300 |
| 60 | 18.0 | 9.0 | 73.0 | 300 |

Example 16

In a glove box with an inert atmosphere of nitrogen, a plating bath was prepared with the following molar composition:

$TiBr_4$:$AlCl_3$:LiCl:Toluene+0.033:0.330:0.198:1.00

The Ti (IV) species were reduced to Ti (II) by reaction with an excess of about 5 g of Al particles, at 60°-80° C. during 24 hours.

The electrolyte was placed afterwards in a cylindrical glass electrolysis cell. Two plane Al anodes of dimensions 5.0×2.5×0.2 cms were used. The agitation was insured by a magnetic stirrer.

A sample of Ni base superalloy Inconel 738 of dimensions 3.5×6.0×0.5 cms was sandblasted, degreased in hot acetone and dried. Afterwards, the sample was introduced into the electrolysis cell. Before the deposition step, the surface of the superalloy sample was cleaned by an anodisation step, in the same electrolyte, at 4 mA/cm² with a charge corresponding to 5 Asec/cm². Afterward the deposition of TiAl alloy was made with a pulse current with ipc=20 mA/cm² and on:off=1:1 msec. After the passage of a charge of 160 Asec/cm², a deposit thickness of about 40 um of TiAl (20 w% Ti, 80 w% Al) was obtained.

After washing with water and acetone to remove the traces of electrolyte, the coated Inconel 738 sample was introduced into a furnace heated at 1000° C., in air. The diffusion treatment lasted 24 hours.

After the thermal treatment, a coating layer of 55-60 um was observed under the microscope. The thickness of the coating was limited by a diffusion zone constituted by a chromium rich layer, resulting from the preferential diffusion of Ni from the Inconel 738 substrate. The composition of the coating is shown in Table 10 below.

TABLE 10

| Component | Coating composition As deposit (w %) | After diffusion (w %) |
|---|---|---|
| Al | 82.6 | 21.7 |
| Ti | 17.4 | 3.8 |
| Cr | 0 | 6.2 |
| Ni | 0 | 61.8 |
| Co | 0 | 6.5 |

After diffusion the proportion of different coating components showed that the coating layer was principally composed of a matrix of NiAl with high Ti content.

Example 17

A TiAl coated sample of Inconel 738 was prepared as in example 16. The TiAl deposit composition and thickness were in the range of 20% Ti—80% Al and 35-40 um.

The diffusion formation step of the aluminide coating from the TiAl deposit was performed directly under the test conditions.

The oxidation resistance of the coating was tested under thermal cycling conditions in static air. The thermal cycle was defined as follows: 23.5 hours at 1000° C. followed by 0.5 hours at room temperature.

The oxidation resistance, and the stability towards diffusion of the coating were demonstrated by the evolution of the specific weight modification and the microstructure of the sample. The results after 2500 hours of exposure are listed in Table 11.

TABLE 11

| Sample | weight gain (mg/cm₂) | oxidation penetration (um) | (Al/Ni) atomic ratio of coating |
|---|---|---|---|
| TiAl coated IN 738 | +0.25 | None | 0.76 |
| Uncoated | −19.0 | 200-300 | — |

These results demonstrate the good oxidation resistance and adherence of the $Al_2O_3$ scale developed at the coating surface, and the excellent stability of the coatings towards excessive outward diffusion of Ni from the substrate.

Example 18

A TiAl coated sample of Nimonic 90 (dimensions 2.5×6.0×0.15 cms) was prepared as in example 16. The deposit thickness and composition were in the range of 35-40 um and 20% Ti—80% Al.

The coated sample was submitted directly to the hot corrosion conditions simulated by spraying on the sample surface a solution of 0.9 mole/l of $Na_2SO_4$+0.1 mole/l $K_2SO_4$, in such a way that the dried salt load was in the range of 1.0 to 1.5 mg/cm². The hot corrosion test conditions were as follows:

Temperature: 900° C.

Salt load: 1.0-1.5 mg/cm² every 48 hours

Thermal cycle: 47 hours at 900° C.—1 hour at room temperature.

The corrosion resistance of the coating was demonstrated by the evolution of the specific weight gain and the microstructure of the sample. The results after 360 hours of exposure are listed in Table 12.

TABLE 12

| Sample | weight gain (mg/cm2) | sulfur penetration (um) | coating thickness after test (um) |
|---|---|---|---|
| TiAl coated Nimonic 90 | 0 | None | 35 |
| Uncoated Nimonic 90 | −3.8 | 150–200 | — |

We claim:

1. A method of electroplating an alloy of one or more transition metals of groups IVB, VB or VIB of the periodic table with aluminum at near ambient temperature onto an electrically conductive substrate in a non-aqueous electrolyte, characterized by the electroplating being carried out in an electrolyte comprising an aromatic hydrocarbon and an aluminum halide, wherein said transition metal(s) has (have) been dissolved in a high oxidation halide state and then pre-reduced to a lower oxidation state.

2. The method of claim 1, characterized by the pre-reduction of said transition metal(s) being carried out by addition of a metallic reducing agent in the elemental state.

3. The method of claim 2, characterized by the reducing agent comprising one of the transition metals being plated, Al or an alkali metal.

4. The method of claim 2, characterized by the reducing agent being Mg.

5. The method of claim 1 or 2 characterized by the aromatic hydrocarbon being benzene, or an alkyl benzene of the group toluene, ethyl benzene, xylene or mixtures thereof, the transition metals being dissolved therein in the form of bromides and or chlorides, the electrolyte further comprising an alkali metal halide.

6. The method of claim 5, characterized in that the molar concentration of the halide(s) of the transition metal(s):the aluminum halide:the aromatic hydrocarbon is in the range of 0.02–0.20:0.05–0.50:1, the cathodic plating current density being in the range of 5–100 $mA/cm^2$.

7. The method of claim 6, characterized by the reducing agent having a molar concentration of 0.02–0.20 per 1.0 mole of the aromatic hydrocarbon.

8. The method of claim 7, characterized by the alkali metal halide having a molar concentration of 0.01–0.3 per 1 mole of the aromatic hydrocarbon.

9. The method of claim 8, characterized by the alkali metal halide being a chloride or a bromide of Li, Na or K.

10. The method of claim 9, characterized by the electrolyte comprising $TiBr_4$, $AlBr_3$, toluene, Mg and one of LiCl and KBr in the following composition (expressed in moles):

| | |
|---|---|
| $TiBr_4$: | 0.025–0.1 |
| $AlBr_3$: | 0.20–0.33 |
| toluene: | 1 |
| Mg: | 0.01–0.13 |
| LiCl or KBr: | 0.005–0.15. |

11. The method of claim 10, characterized by the electrolyte comprising 0.01–0.05 gr. at. of Mg particles, 0.05–0.15 moles KBr and an additional amount of 0.1–0.3 moles of $AlBr_3$ per mole toluene, the $AlBr_3$ being added to the electrolyte after the initial pre-reduction of the $Ti^{4+}$ ions to $Ti^{2+}$ ions by the Mg.

12. The method of claim 9, characterized by the electrolyte comprising $MoBr_3$, $AlBr_3$, toluene, and Mg in a molar (gr. at.) concentration of 0.01–0.05:0.1–0.5:1:0.01–0.05, with 0.1–0.3 moles KBr per mole toluene being added to the electrolyte after pre-reduction of the $Mo^{3+}$ ions to a lower oxidation state by the Mg.

13. The method of claim 9, characterized by the electrolyte comprising $MoBr_3$, $AlBr_3$, toluene, and Al in a molar (gr. at.) concentration of 0.01–0.05:0.1–0.5:1:0.01–0.05, with 0.1–0.3 moles LiCl per mole toluene being added to the electrolyte after pre-reduction of the $Mo^{3+}$ ions to a lower oxidation state by the Al.

14. The method of claim 9, characterized by the electrolyte comprising $CrCl_3$, $AlCl_3$, LiCl, toluene and Al in a molar concentration of 0.02–0.05:0.2–0.5:0.15–0.25:1:0.05–0.20.

15. The method of claim 14, characterized by the electrolyte further comprising 0.0025–0.100 moles of $TiBr_4$.

16. The method of either of the claims 1 or 2, characterized by the ions of at least one of the electroplated metals being substantially continuously fed into the electrolyte by means of feed anodes.

17. The method of either of claims 1 or 2, characterized by the substrate comprising nickel, cobalt, iron and/or titanium.

18. The method of claim 17, characterized by the substrate encompassing an intermediate layer comprising nickel.

19. A method as described in claim 17 and further characterized in that said electroplating is carried out until an electrodeposited alloy coating at least several microns thick has been formed on said substrate, and the resulting coated substrate thus obtained is heat treated at temperatures between about 400° C. and about 1200° C. to achieve substantial interdiffusion of metallic components from the substrate into the coating.

20. A coated substrate produced by the method of claim 19.

21. The method of claim 19, wherein during said heat treating step at least one intermetallic compound is formed between metallic components from the substrate and from the coating.

22. The method of claim 21, wherein such an intermetallic compound is formed which is stable at temperatures up to about 1500° C.

23. A coated substrate produced by the method of claim 21.

24. A coated substrate having an electroplated alloy coating thereon formed by the method described in claim 5.

25. The coated substrate of claim 24, characterized by a coating composition of 1–95 wt% of the transition metal(s) and 99–5 wt% of Al.

26. The use in an environment involving corrosive aqueous solutions and/or high temperature oxidizing atmospheres of a coated substrate produced by the method of claim 19.

* * * * *